US011512554B2

(12) United States Patent
Deng et al.

(10) Patent No.: US 11,512,554 B2
(45) Date of Patent: Nov. 29, 2022

(54) SEGMENTED BACKUP RING, SYSTEM AND METHOD

(71) Applicants: Guijun Deng, The Woodlands, TX (US); Kevin Holmes, Houston, TX (US); Daniel Ewing, Katy, TX (US); Keith J. Murphy, Hartford, CT (US)

(72) Inventors: Guijun Deng, The Woodlands, TX (US); Kevin Holmes, Houston, TX (US); Daniel Ewing, Katy, TX (US); Keith J. Murphy, Hartford, CT (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

(21) Appl. No.: 17/021,536

(22) Filed: Sep. 15, 2020

(65) Prior Publication Data

US 2022/0081991 A1 Mar. 17, 2022

(51) Int. Cl.
*E21B 33/12* (2006.01)

(52) U.S. Cl.
CPC ..... *E21B 33/1216* (2013.01)

(58) Field of Classification Search
CPC combination set(s) only.
See application file for complete search history.

(56) References Cited

U.S. PATENT DOCUMENTS 4,509,763 A 4/1985 Fischer
7,614,449 B2 * 11/2009 Anderson ..... E21B 33/129 166/216
8,083,001 B2 * 12/2011 Conner ..... E21B 33/1216 166/387
10,012,053 B2 * 7/2018 Xu ..... E21B 33/129
10,526,864 B2 1/2020 Deng et al.
10,704,355 B2 7/2020 Deng et al.
2002/0043368 A1 * 4/2002 Bell ..... E21B 33/1216 166/134
2006/0290066 A1 12/2006 Hiorth
(Continued)

FOREIGN PATENT DOCUMENTS

EP 1197632 A2 4/2002
WO 20110028404 A2 3/2011

OTHER PUBLICATIONS

Notification of Transmittal of the International Search Report and the Written Opinion of the International Searching Authority, or the Declaration; PCT/US2021/050241; dated Dec. 24, 2021; 8 total pages.

*Primary Examiner* — Giovanna Wright
*Assistant Examiner* — Ronald R Runyan
(74) *Attorney, Agent, or Firm* — Cantor Colburn LLP

(57) ABSTRACT

A segmented backup ring including a plurality of individual segments each having curved surfaces that define an arcuate portion of the ring, each segment including a body section having the arcuate profile and defining a receptacle therein having a circumferential dimension, a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle.

22 Claims, 11 Drawing Sheets

(56) References Cited

U.S. PATENT DOCUMENTS

| | | | | |
|---|---|---|---|---|
| 2011/0048744 | A1* | 3/2011 | Conner | E21B 33/1216 166/134 |
| 2018/0163492 | A1* | 6/2018 | Kellner | E21B 34/14 |
| 2019/0360297 | A1 | 11/2019 | Heiman et al. | |

* cited by examiner

SEGMENTED BACKUP RING, SYSTEM AND METHOD

BACKGROUND

In the resource recovery industry the sealing of sections of borehole whether cased or open hole is ubiquitous. Seals, including packers, may be permanent or temporary and are used for many different processes in the downhole environment. Innovations are always sought to improve reliability and cost effectiveness. One of the pervasive issues related to packer use is extrusion of a packing element due to pressure differential across the set element. In order to combat this phenomenon, back up rings are used. Many have been tried and used and some have reasonable success but the quest for better backup rings and better performance is unyielding. Therefore the art will welcome improved backup rings and systems that resist extrusion.

SUMMARY

An embodiment of a segmented backup ring including a plurality of individual segments each having curved surfaces that define an arcuate portion of the ring, each segment including a body section having the arcuate profile and defining a receptacle therein having a circumferential dimension, a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle.

An embodiment of a segment for a segmented backup ring including a body section having an arcuate profile and defining a receptacle therein having a dimension in a direction of an arc of the arcuate profile, a projection section having a head portion and a neck portion and extending from the body section in the direction of the arc of the arcuate profile, the projection section being receivable and retainable in the receptacle of an adjacent segment body section, and the head portion having a dimension in line with the direction of the arc of the arcuate profile that is shorter than the dimension of the receptacle in the direction of the arc of the arcuate profile.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

For purposes of this application the term "circumferential" is used more broadly than a strict dictionary definition might suggest. As will be familiar to those of skill in the downhole arts, both boreholes and tubular members, such as casings and tubing strings, in those boreholes may actually be of circular cross section but they also may be (and often are) out-of-round in cross section to include shapes such as ovals and even irregular shapes. The term "circumferential" as used herein is intended to encompass those out-of-round shapes as well.

Figure 1:
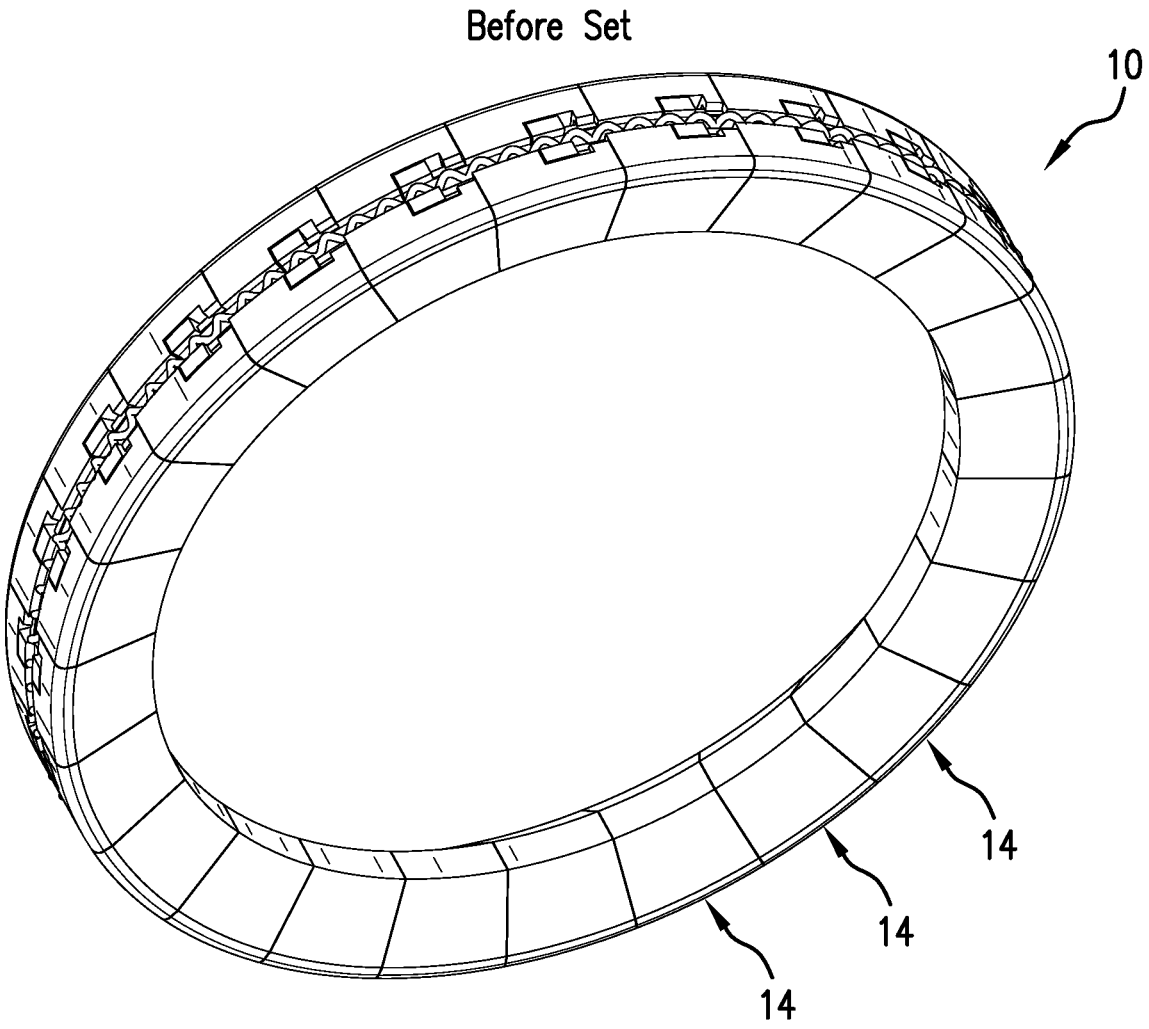
FIG. 1 is a perspective view of a segmented backup ring as disclosed herein in a radially unexpanded position.
Figure 2:
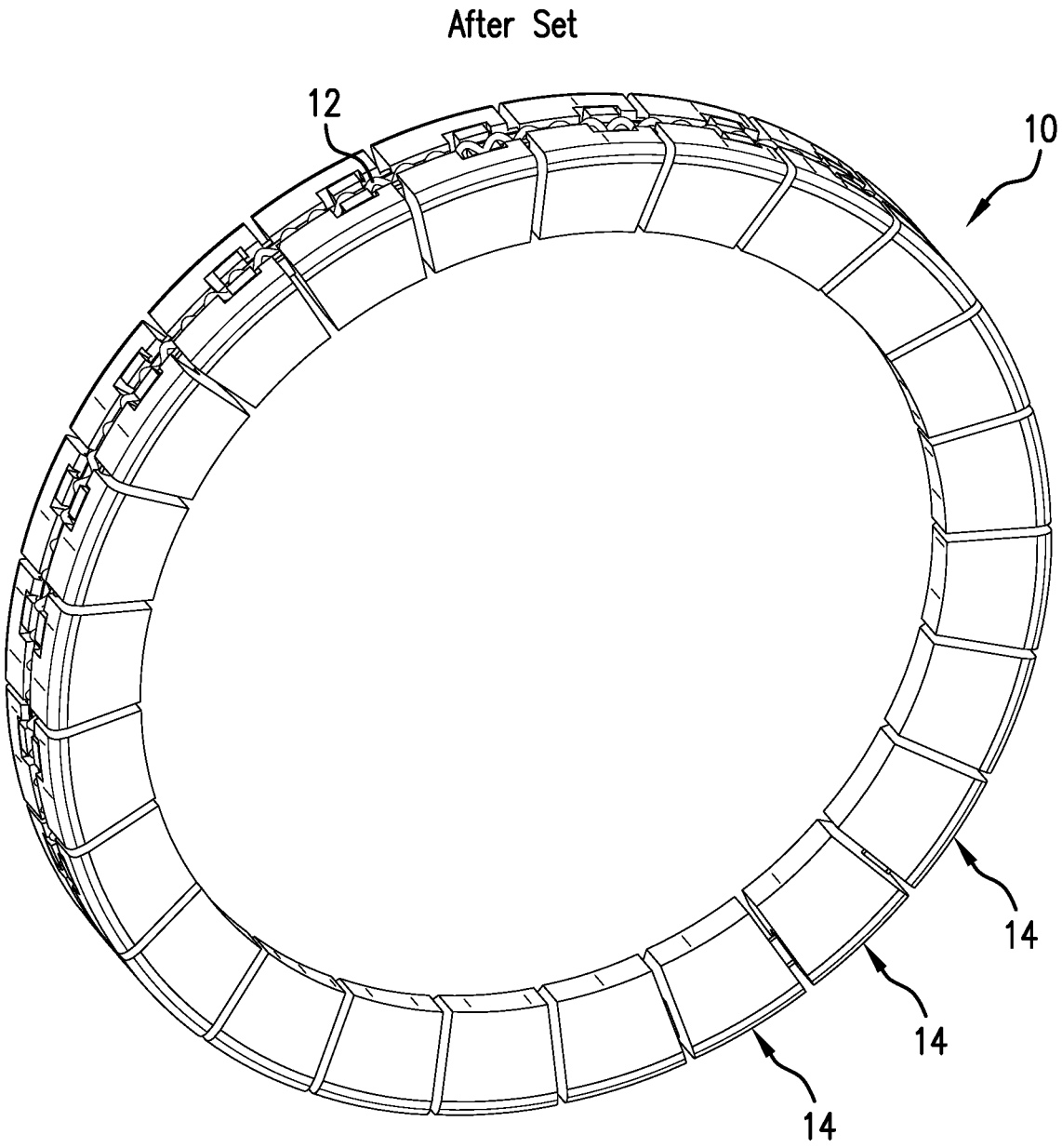
FIG. 2 is a perspective view of the segmented backup ring as disclosed herein in a radially expanded position.

Referring to FIGS. 1 and 2, a segmented backup ring 10 is illustrated. In FIG. 1, the ring 10 is in a position prior to expansion while FIG. 2 illustrates the same ring 10 in an expanded position. The expanded position is a set position for this backup ring. The degree of expansion is preselected by geometry of certain components thereof which will become apparent hereunder. The limitation of the ability to expand radially is selected to cause a particular backup ring 10 to expand only so far and that amount of expansion is related to the inside dimension of a tubular form in which the backup ring 10 is to be set. The tubular form may be cased or open hole and the backup ring as disclosed herein has a high degree of compliance to better accommodate out of round tubular structures than prior art backup rings have evidenced. This is a benefit of the ring embodiments disclosed herein. An additional benefit is that because the segments are individual, the setting force required for the backup ring embodiments disclosed herein is substantially less than prior art single piece rings.

Regardless of whether the tubular structure or form is a casing or open hole, the backup ring 10 is specifically configured to expand into proximity with the tubular structure but not make contact therewith annularly during the setting operation. Rather, the ring 10 is limited in radial expansion capability to ensure that a gap is created between the fully expanded ring 10 and the inside surface of the tubular form of about 0.010 to 0.050 inches. Limiting the radial expansion as described reduces the amount of friction created by contact between the backup ring 10 and the tubular form thereby maximizing force input to an element that will be used with the backup ring 10. Also, the ring 10 includes a resilient member 12 that is positioned to retract the ring 10 to is unexpanded position in the absence of an input that will cause expansion thereof. This helps during unsetting of a seal system that uses the segmented backup ring 10. Other embodiments retain the resilient functionality with alternate resilient member geometry and configuration. These are discussed with reference to FIGS. 6, 7, and 8 below.

Figure 3:
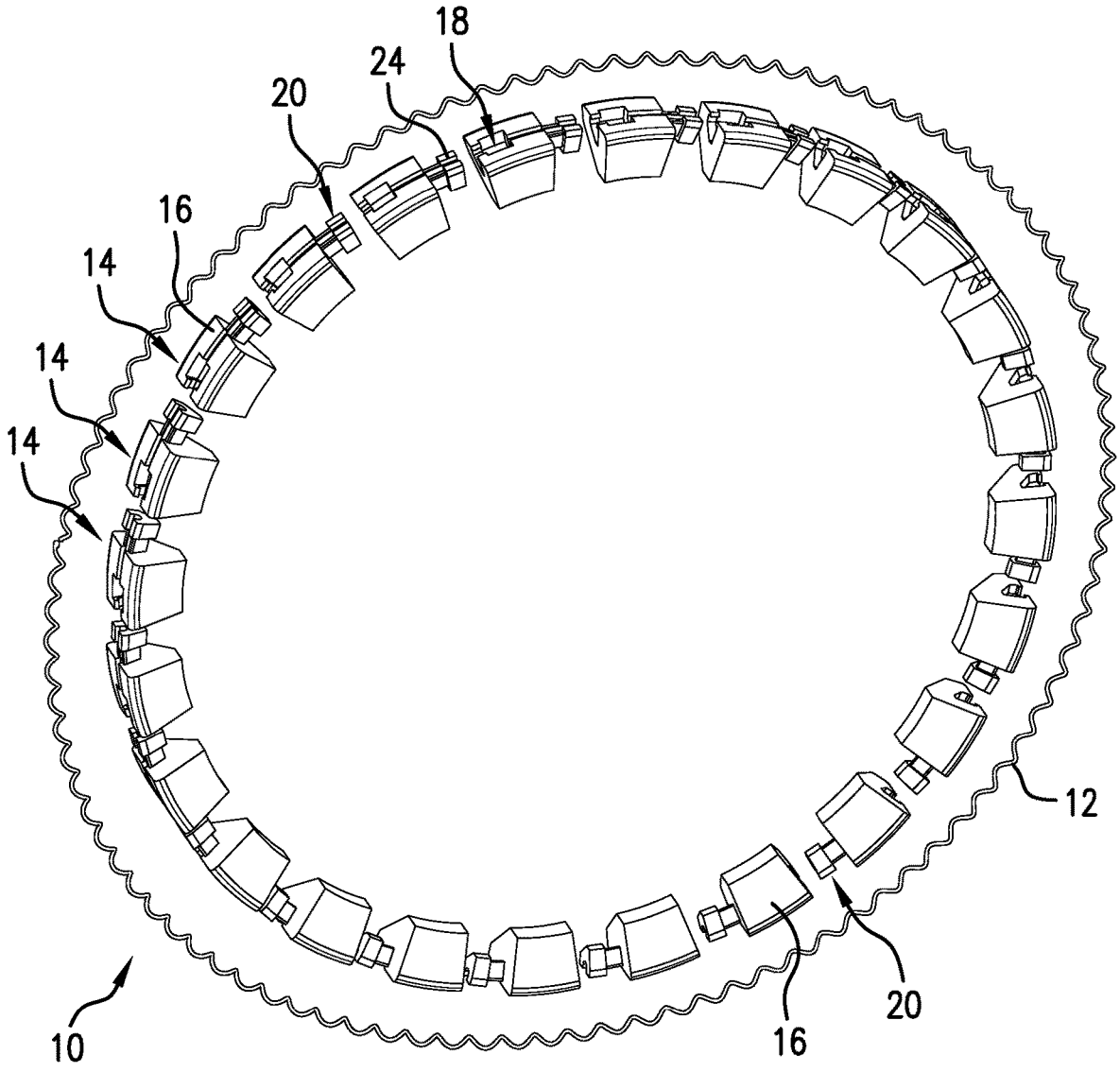
FIG. 3 is an exploded view of a segmented backup ring as disclosed herein.
Figure 4:
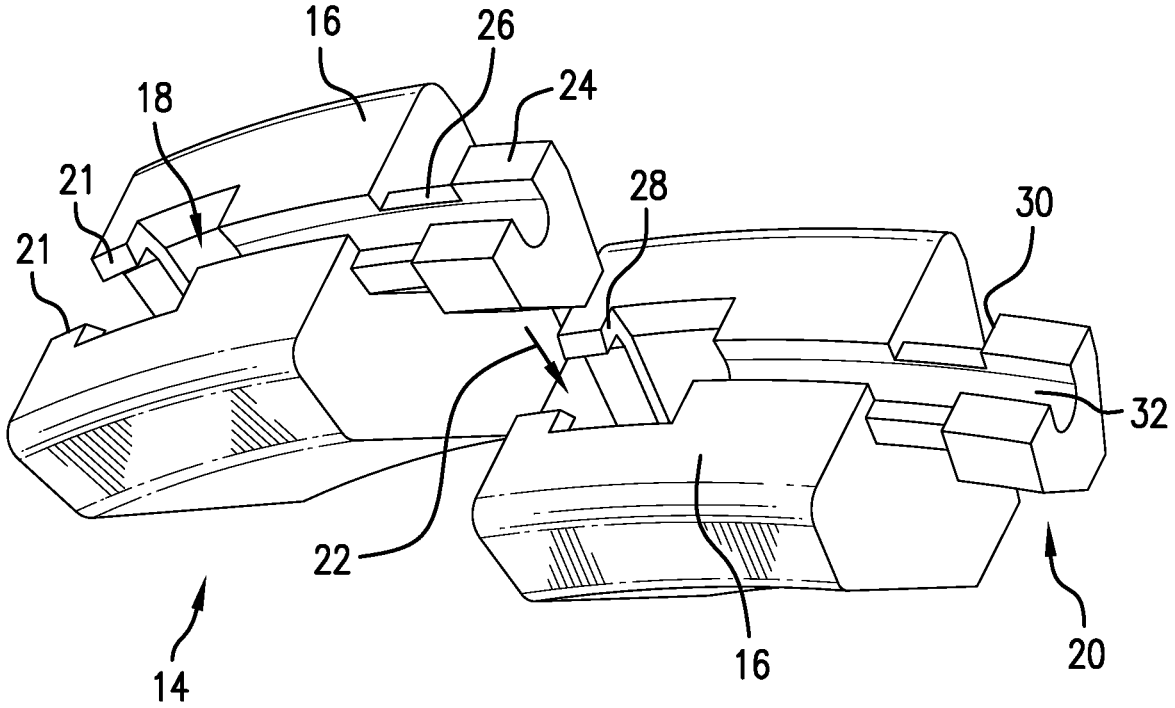
FIG. 4 is a view of two segments of the segmented backup ring apart from other components and illustrating direction of connection.

Referring to FIGS. 3 and 4, the segments and their interaction can be appreciated. FIG. 3 shows a plurality of the individual segments in exploded form. The resilient member 12 exploded radially outwardly of the exploded segments is consistent with FIG. 2.

As can be appreciated, there are a number of individual segments 14 (here illustrated as 24 segments but more or fewer are contemplated) that together form a ring 10. It may be that one or more of the segments are identical to one another. Each segment 14 may be formed by casting, injection molding, subtractive machining, additive manufacture, etc. Further, the segments 14 may be constructed of materials such as metal, plastic, etc.

In FIG. 4, two segments are illustrated in an enlarged format. It will be appreciated that in the illustrated embodiment, the two adjacent segments are identical to one another. It is contemplated that they need not be identical. At least some of the segments 14 include a body section 16 with a receptacle 18. Each segment 14 will either include a receptacle 18, or a projection 20, or both (as illustrated in FIG. 4).

Still referring to FIG. 4, the projection 20 is dimensioned, positioned, and configured to engage with the receptacle 18 of an adjacent segment 14. As illustrated the segments 14 are engaged as shown by arrow 22. The segments 14 may be permanently connected together by hand by forcing the projection 20 past detents 21 into the receptacle in the direction of arrow 22. Because the detents 21 only allow one-way passage of the projection 20 into the receptacle 18, the assembled segments 14 are permanently connected and cannot become dislodged during wellbore activities.

Still referring to FIG. 4, projection 20 includes a head 24 and a neck 26. The receptacle 18 is sized and shaped to receive the head 24 and neck 26 in the receptacle 18. Receptacle 18 also includes shoulder 28 against which a surface 30 of head 24 will bear when the ring 10 is in the expanded position. The head surface 30 bearing upon shoulder 28 is the limiting factor on the radial expansion capability of the ring 10. Particularly, the expansion capability is dictated by the distance between the shoulder 28 and surface 30 when the ring 10 is in the unset position. The greater that distance, the greater the radial expansion before the limiting factor of contact between shoulder 28 and surface 30 is met. One last feature visible well in FIG. 4 is a groove 32 into which resilient member 12 is placed. It is noted that each segment 14 may be integrally formed, or the body 16 and projection 20 may be separately formed and attached to each other by such as fasteners, welding, adhesive, etc., or even the head 24 and neck 26 of projection 20 could be individually formed and attached to each other and then to the body 16 by such as fasteners, welding, adhesive, etc.

Figure 5:
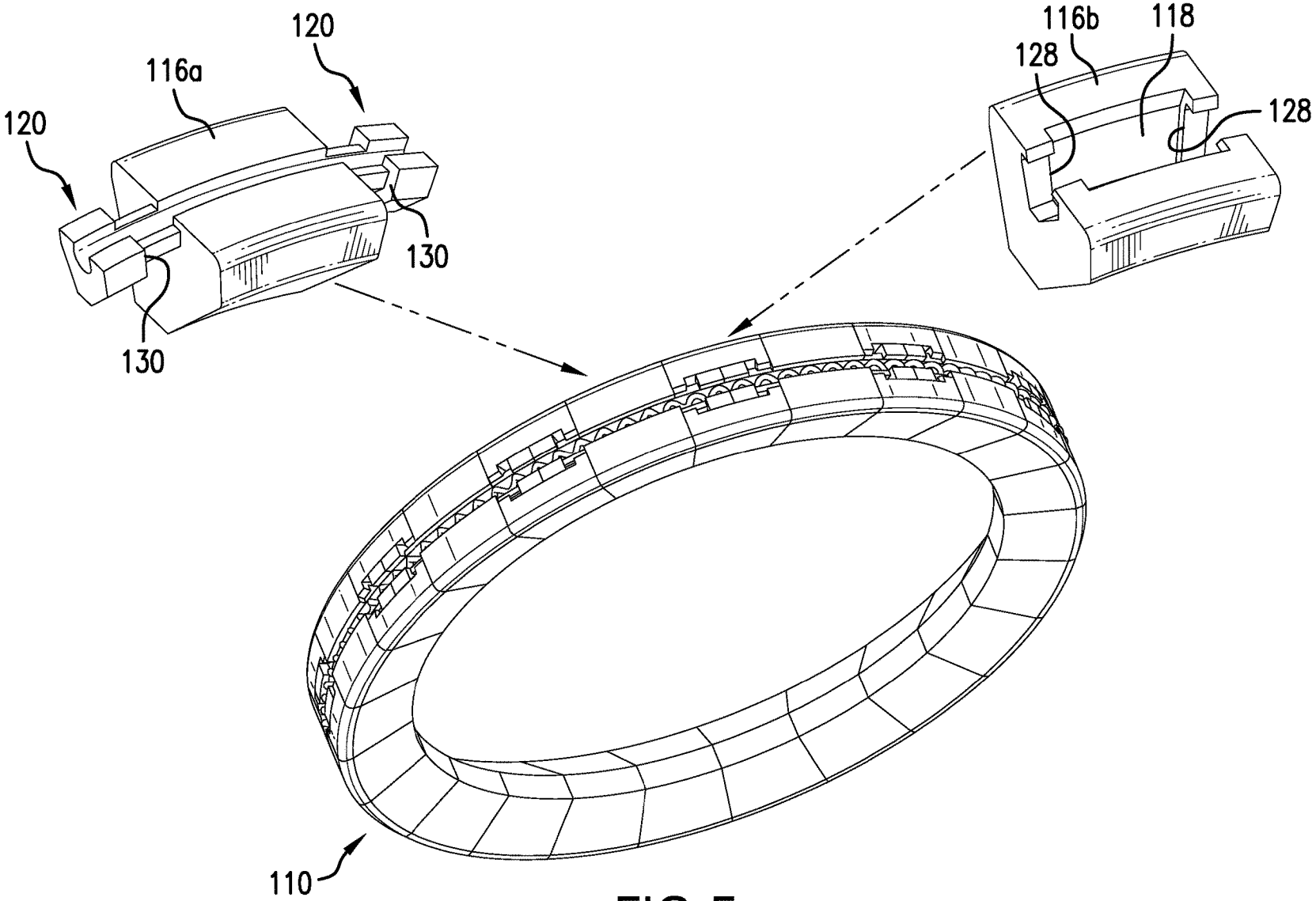
FIG. 5 is a perspective view of an alternate embodiment of the ring.

In a related embodiment alluded to above, referring to FIG. 5, a single body section 116*a* may include two projections 20 extending from the body section 116*a* in opposing directions or a single body section 116*b* may include a double receptacle 118. These body sections 116*a* and *b* will, in use, be interspersed with one another as seen in FIG. 5. Since the receptacles 118 provide two shoulders 128, and the projections provide surfaces 130, the interaction of the body sections 116*a* and *b* will be identical to the embodiment of FIG. 4 regarding expansion to a limited maximum dimension. Specifically, the circumferential distance between shoulders 128 and their mating surfaces 130 when the ring is collapsed will indicate the degree of expansion possible for the assembled ring 110 before the shoulders 128 and respective surfaces 130 make contact and limit further expansion of the ring 110.

Figure 6:
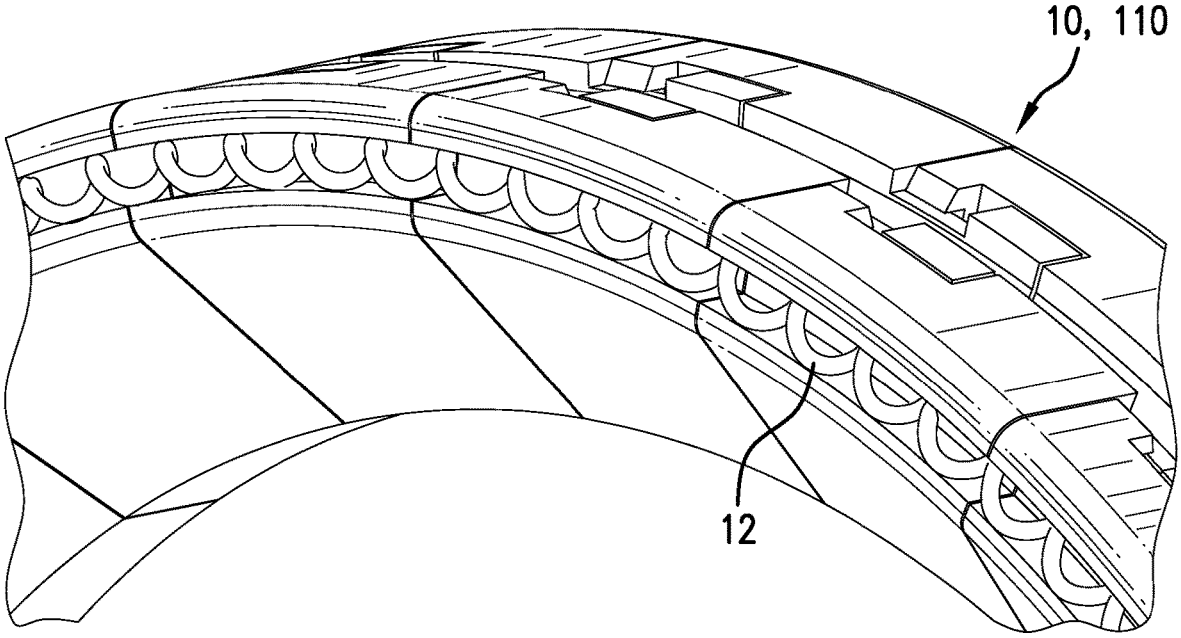
FIG. 6 is a perspective enlarged perspective view illustrating a resilient member at a side of the ring.
Figure 7:
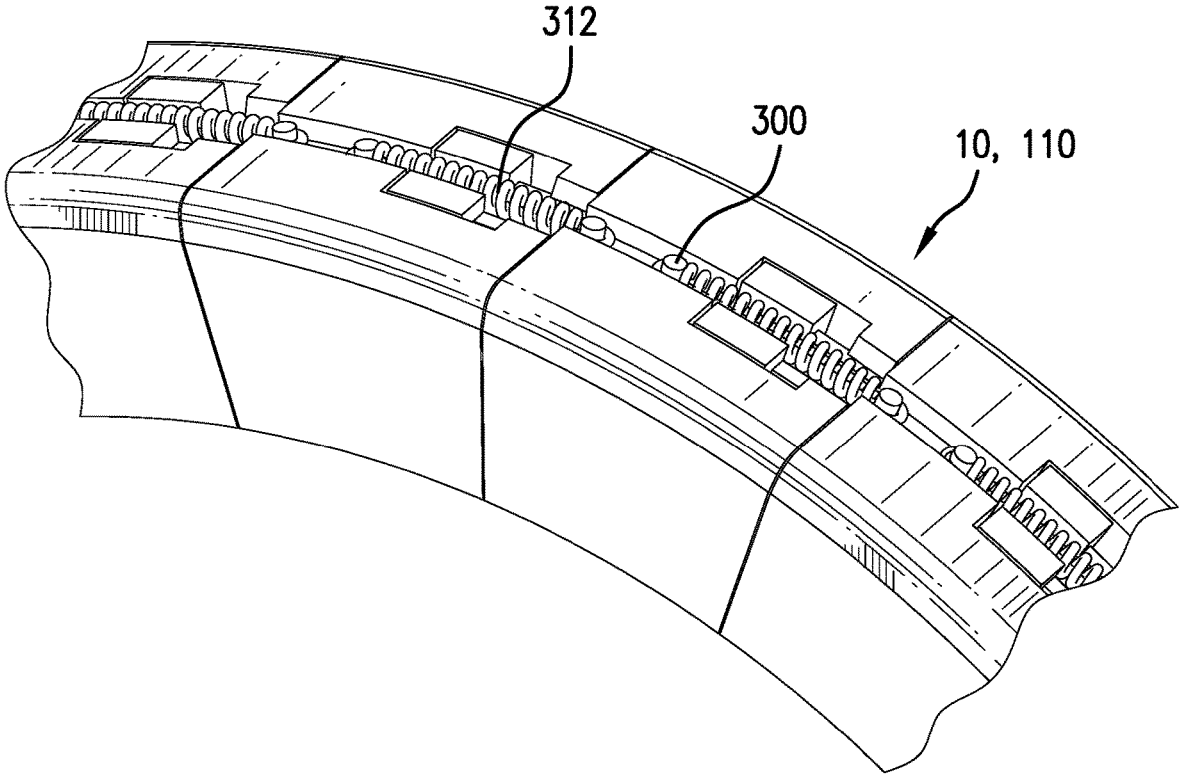
FIG. 7 is an enlarged perspective view of an embodiment where multiple resilient members are used to join adjacent segments on a circumferential face of the ring.
Figure 8:
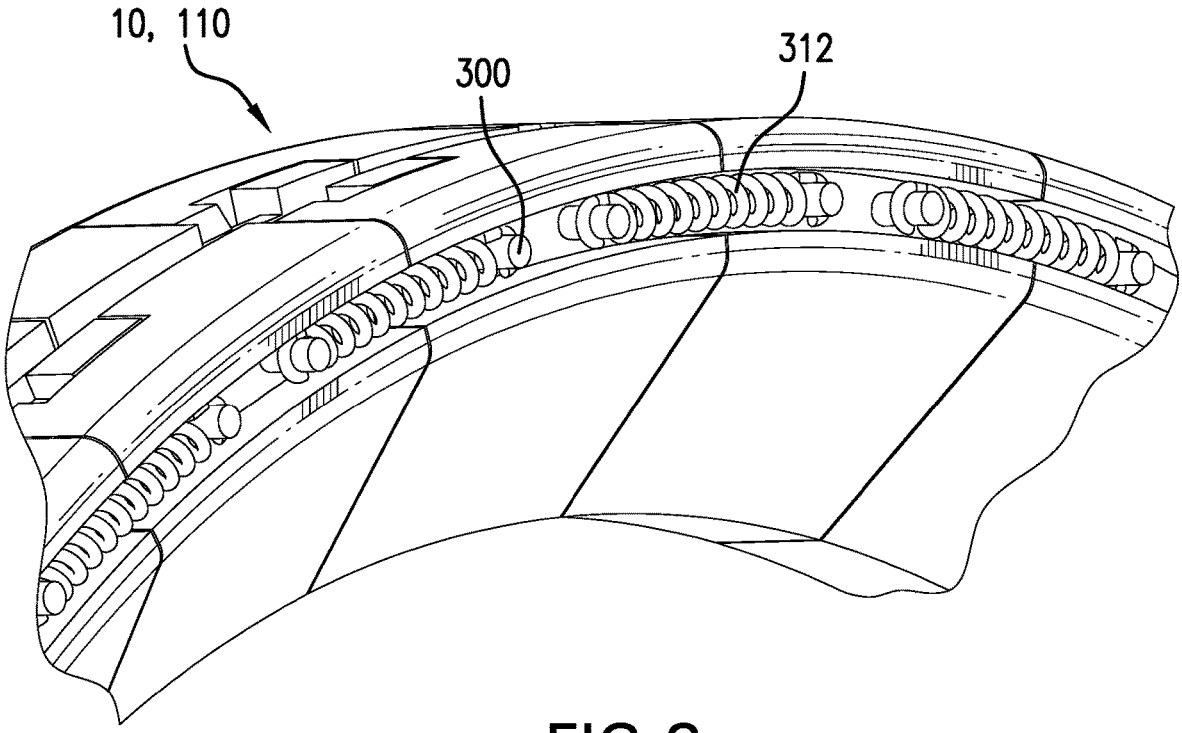
FIG. 8 is an enlarged perspective view of an embodiment where multiple resilient members are used to join adjacent segments on a side face of the ring.

Referring to FIGS. 6-8, alternate embodiments that retain the resilient functionality differently are presented. In FIG. 6, an embodiment of ring 10 or 110 may be configured with a resilient member 12 along a side of the ring 10, 110 as shown. In another embodiment, illustrated in FIGS. 7 and 8, a number of non-annular resilient members may be employed to serve the same purpose relating to retrievability. In this embodiment, anchors 300 are shown as pins but other configurations could be substituted. Resilient members 312 are positioned between anchors 300 on adjacent or otherwise spaced segments 14 to pull the segments toward each other. In FIG. 7, the resilient members are positioned at the circumferential face of the ring 10, 110 and in FIG. 8, they are positioned along a side of the ring 10, 110.

Figure 9:
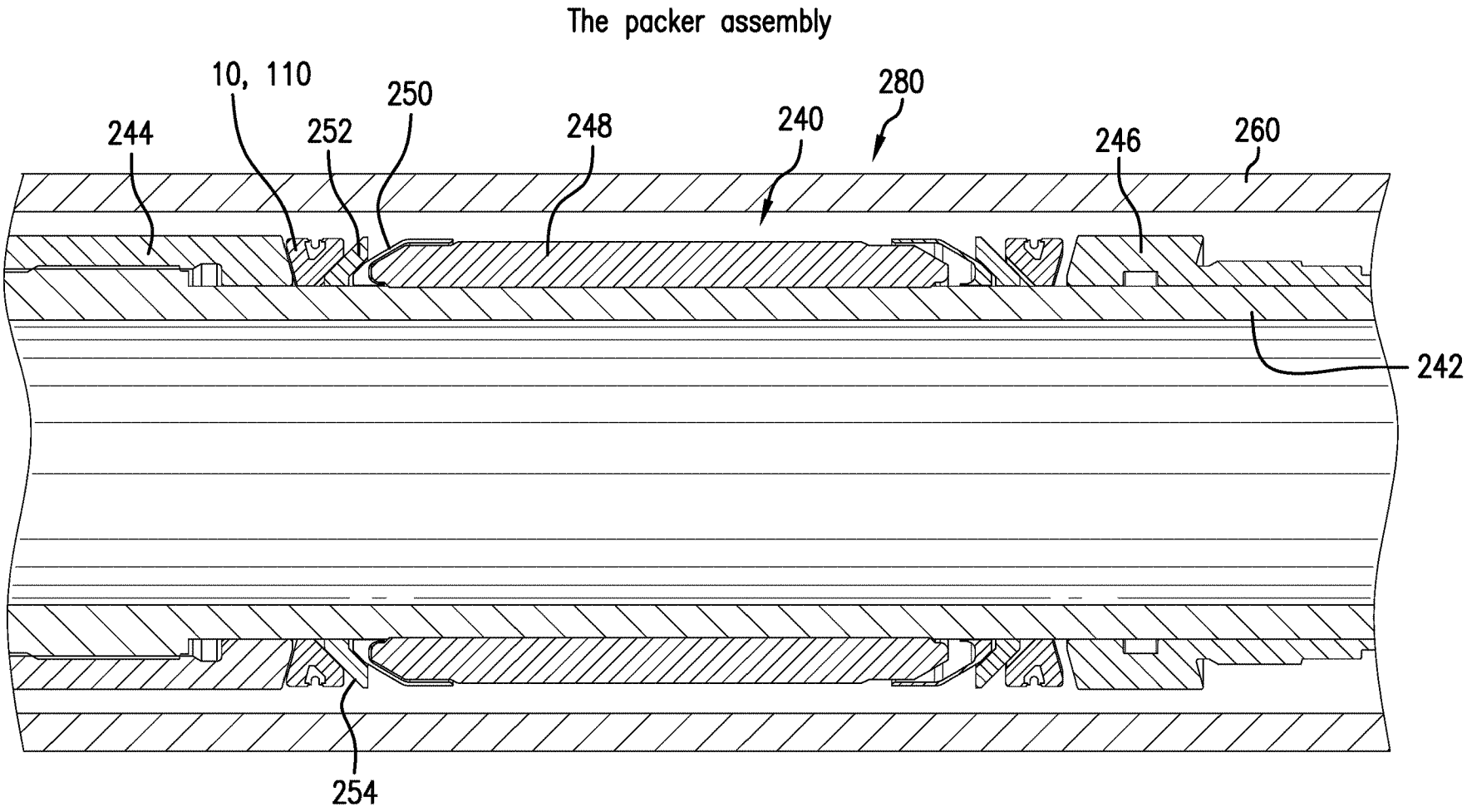
FIG. 9 is a longitudinal cross section view of a seal system in a tubular structure in an unexpanded position.
Figure 10:
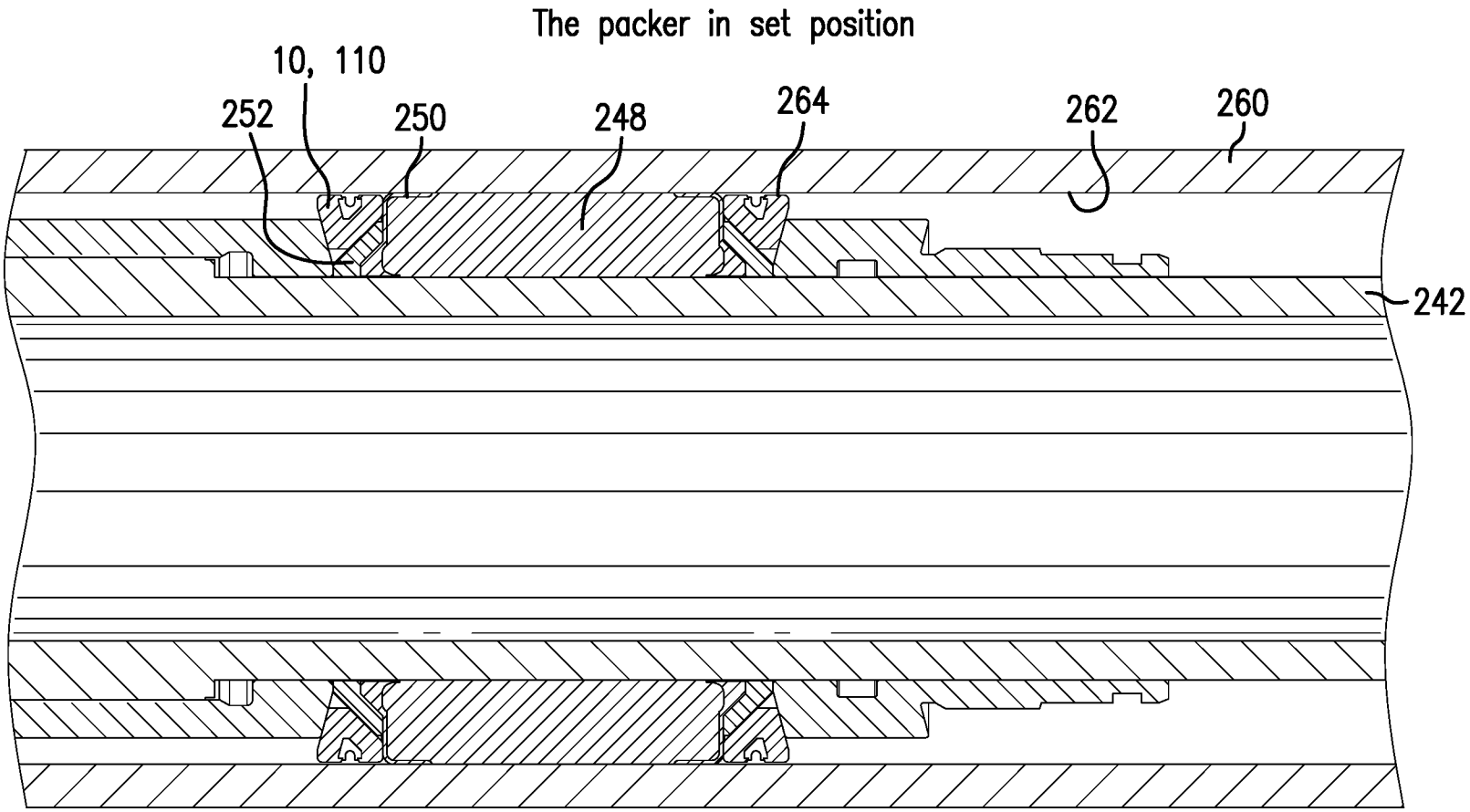
FIG. 10 is a longitudinal cross section view of a seal system in a tubular structure in an expanded (set) position.
Figure 11:
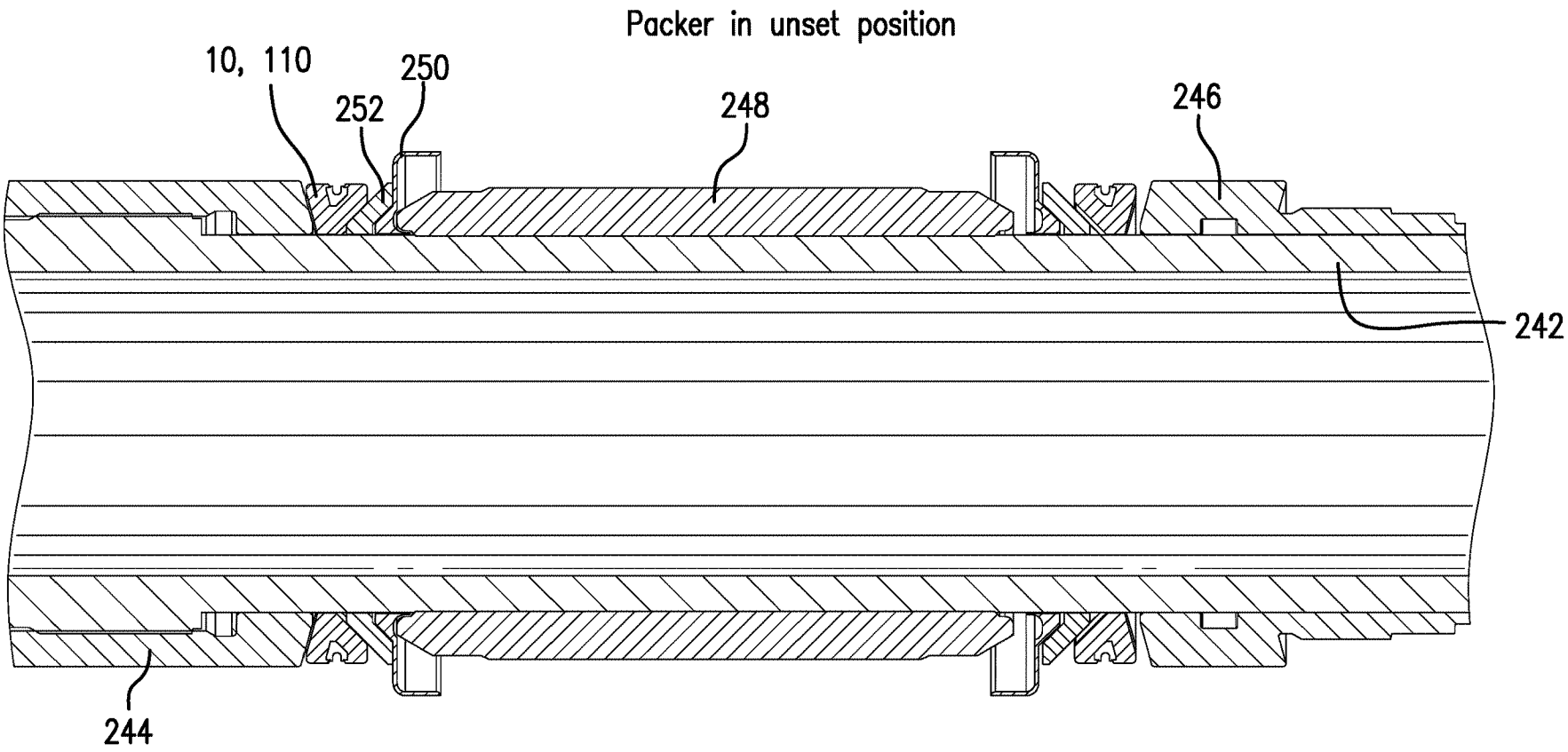
FIG. 11 is a longitudinal cross section view of a seal system in a tubular structure in a retracted position.

Referring to FIGS. 9-11, a seal system 240 in accordance with the disclosure hereof is illustrated within a tubular structure 260 (intended to represent either a tubular member within a borehole such as casing or tubing or an open borehole since the seal system 240 may be set in cased or open hole) that may be a part of a tubular string of a wellbore, which together form a borehole system 280. The seal system 240 comprises a mandrel 242 upon which is mounted a stationary gauge ring 244 and a moveable gauge ring 246. An element 248 is also mounted to the mandrel 242 as well as a metal backup 250, a spacer ring 252 and a segmented backup 10, 110 as disclosed herein. The spacer ring presents a frustoconical surface 254 thereon to interact with the segmented backup ring 10,110 to cause the ring 10, 110 to expand radially outwardly, which action is most easily appreciated by comparing FIGS. 9 and 10. The system 240 functions through compression by moving the gauge ring 246 toward the gauge ring 244. In FIG. 10, the result of the compressive action is illustrated. Positioning of components is substantially familiar except that it is important to note that the maximum obtained diameter of the segmented ring 10, 110 is less than a dimension of an inside surface 262 of the tubular structure 260. A gap 264 can be seen in FIG. 10. This is the gap described above and will be in a range of about 0.010 to 0.050 inch to avoid friction against the inside surface 262 during setting of the system 240 and still efficiently support the metal backup 250 so that it will not shear upon loading by the element 248. While this paragraph is couched in terms of setting in a string, it is to be understood as alluded to above, that this system 240 may also be set in open hole so the structure 260 should be understood to represent either tubing or open hole wall.

Also noted above, the segmented backup ring 10, 110 is efficiently retrievable due to resilient member 12. The position of the various components of system 240 are illustrated in the retrieval condition in FIG. 11.

Set forth below are some embodiments of the foregoing disclosure:

Embodiment 1: A segmented backup ring including a plurality of individual segments each having curved surfaces that define an arcuate portion of the ring, each segment including a body section having the arcuate profile and defining a receptacle therein having a circumferential dimension, a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle.

Embodiment 2: The ring as in any prior embodiment, wherein the circumferential dimension of the receptacle relative to the circumferential dimension of the head dictates change in radial dimension of the ring during setting.

Embodiment 3: The ring as in any prior embodiment, wherein a surface of the head coming into contact with a surface of the receptacle limits radial expansion of the backup ring.

Embodiment 4: The ring as in any prior embodiment, wherein the change in radial dimension of the ring is limited to create a gap between the ring and a tubular structure in which the ring to be set to reduce friction drag of the ring against the tubular structure during setting.

Embodiment 5: The ring as in any prior embodiment, further being biased to a smallest circumferential dimension of the ring.

Embodiment 6: The ring as in any prior embodiment, further including a resilient member.

Embodiment 7: The ring as in any prior embodiment, wherein the resilient member is disposed circumferentially about the plurality of segments.

Embodiment 8: The ring as in any prior embodiment, wherein the resilient member is disposed between a number of the plurality of segments.

Embodiment 9: The ring as in any prior embodiment, wherein the resilient member is disposed along side of the plurality of segments.

Embodiment 10: The ring as in any prior embodiment, wherein the receptacle includes a head receiver and a neck receiver.

Embodiment 11: The ring as in any prior embodiment, wherein the neck receiver is of smaller dimensions than the head receiver.

Embodiment 12: The ring as in any prior embodiment, wherein the neck receiver presents a stop shoulder that interacts with the head when the ring is fully expanded.

Embodiment 13: The ring as in any prior embodiment, wherein a detent is disposed at the neck receiver allowing passage of the neck into the neck receiver and preventing exit of the neck from the neck receiver.

Embodiment 14: A seal system including an element, a backup ring as in any prior embodiment.

Embodiment 15: A wellbore system including a borehole, a seal system having an element and a backup ring as in any prior embodiment disposed in the borehole.

Embodiment 16: A method for sealing in a borehole including running a seal system having an element and a backup as in any prior embodiment into a borehole, radially expanding the backup ring to a dimension less than the inside surface dimension of a tubular structure in which the seal system is to be set and limiting the radial expansion to the lesser dimension, and setting the element.

Embodiment 17: The method as in any prior embodiment, wherein the expanding is by urging the backup ring radially outwardly resulting in the head moving within the receptacle until a surface of the head contacts a surface of the receptacle thereby limiting further movement of the backup ring radially outwardly.

Embodiment 18: The method as in any prior embodiment, further including retracting the backup ring using a resilient member.

Embodiment 19: The method as in any prior embodiment, further including assembling the backup ring of as in any prior embodiment by disposing the head of each segment into the receptacle of the adjacent segment until a completed ring shape is formed and associating a resilient member with the completed ring shape.

Embodiment 20: A segment for a segmented backup ring including a body section having an arcuate profile and defining a receptacle therein having a dimension in a direction of an arc of the arcuate profile, a projection section having a head portion and a neck portion and extending from the body section in the direction of the arc of the arcuate profile, the projection section being receivable and retainable in the receptacle of an adjacent segment body section, and the head portion having a dimension in line with the direction of the arc of the arcuate profile that is shorter than the dimension of the receptacle in the direction of the arc of the arcuate profile.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A segmented backup ring comprising:

a plurality of individual segments each having curved surfaces that define an arcuate portion of the ring, each segment including:

a body section having the arcuate profile and defining a receptacle therein extending from an outer periphery surface of the body section, and the receptacle having a circumferential dimension;

a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle, wherein the circumferential dimension of the receptacle relative to the circumferential dimension of the head dictates change in radial dimension of the ring during setting.

2. The ring as claimed in claim 1, wherein a surface of the head coming into contact with a surface of the receptacle limits radial expansion of the backup ring.

3. The ring as claimed in claim 1, wherein the change in radial dimension of the ring is limited to create a gap between the ring and a tubular structure in which the ring to be set to reduce friction drag of the ring against the tubular structure during setting.

4. The ring as claimed in claim 1, further being biased to a smallest circumferential dimension of the ring.

5. The ring as claimed in claim 1, further including a resilient member.

6. The ring as claimed in claim 5, wherein the resilient member is disposed circumferentially about the plurality of segments.

7. The ring as claimed in claim 5, wherein the resilient member is disposed between a number of the plurality of segments.

8. The ring as claimed in claim 5, wherein the resilient member is disposed along side of the plurality of segments.

9. The ring as claimed in claim 1, wherein the receptacle includes a head receiver and a neck receiver.

10. The ring as claimed in claim 9, wherein the neck receiver is of smaller dimensions than the head receiver.

11. The ring as claimed in claim 9, wherein the neck receiver presents a stop shoulder that interacts with the head when the ring is fully expanded.

12. The ring as claimed in claim 9, wherein a detent is disposed at the neck receiver allowing passage of the neck into the neck receiver and preventing exit of the neck from the neck receiver.

13. A seal system comprising:

an element;

a backup ring as claimed in claim 1.

14. A wellbore system comprising:

a borehole;

a seal system having an element and a backup ring as claimed in claim 1 disposed in the borehole.

15. A method for sealing in a borehole comprising:

running a seal system having an element and a backup ring as claimed in claim 1 into a borehole;

radially expanding the backup ring to a dimension less than the inside surface dimension of a tubular structure in which the seal system is to be set and limiting the radial expansion to the lesser dimension; and setting the element.

16. The method as claimed in claim 15, wherein the expanding is by urging the backup ring radially outwardly resulting in the head moving within the receptacle until a surface of the head contacts a surface of the receptacle thereby limiting further movement of the backup ring radially outwardly.

17. The method as claimed in claim 15, further including retracting the backup ring using a resilient member.

18. The method as claimed in claim 15, further including assembling the backup ring of claim 1 by disposing the head of each segment into the receptacle of the adjacent segment until a completed ring shape is formed and associating a resilient member with the completed ring shape.

19. A segment for a segmented backup ring comprising:

a body section having an arcuate profile and defining a receptacle therein extending from an outer periphery surface of the body section, and the receptacle having a dimension in a direction of an arc of the arcuate profile;

a projection section having a head portion and a neck portion and extending from the body section in the direction of the arc of the arcuate profile, the projection section being receivable and retainable in the receptacle of an adjacent segment body section, and the head portion having a dimension in line with the direction of the arc of the arcuate profile that is shorter than the dimension of the receptacle in the direction of the arc of the arcuate profile, wherein the circumferential dimension of the receptacle relative to the circumferential dimension of the head dictates change in radial dimension of the ring during setting.

20. A segmented backup ring comprising:

a plurality of individual segments each having curved surfaces that define an arcuate portion of the ring, each segment including:

a body section having the arcuate profile and defining a receptacle therein having a circumferential dimension;

a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle such that the head is slidable circumferentially in the recess to enable expanding or contracting of the ring, wherein a change in radial dimension of the ring is limited to create a gap between the ring and a tubular structure in which the ring to be set to reduce friction drag of the ring against the tubular structure during setting.

21. A segmented backup ring comprising:

a plurality of individual segments each having curved surfaces that define an arcuate portion of the ring, each segment including:

a body section having the arcuate profile and defining a receptacle therein having a circumferential dimension;

a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle, such that the head is slidable circumferentially in the recess to enable expanding or contracting of the ring, wherein a resilient member is in a groove on a periphery of the plurality of segments.

22. A segmented backup ring comprising:

a plurality of individual segments each having curved surfaces that define an arcuate portion of the ring, each segment including:

a body section having the arcuate profile and defining a receptacle therein extending from an outer periphery surface of the body section, and the receptacle having a circumferential dimension;

a projection section having a head portion and a neck portion and extending from the body section in a circumferential direction of the ring, the projection section being receivable and retainable in the receptacle of an adjacent segment body section, and the head portion having a dimension in line with the circumferential direction of the ring that is shorter than the circumferential dimension of the receptacle, including a resilient member having a first end terminated at one segment body and second end terminated at an adjacent segment body.

* * * * *